United States Patent [19]

Fredrixon

[11] Patent Number: 4,561,262

[45] Date of Patent: Dec. 31, 1985

[54] TOP STRUCTURE

[75] Inventor: Benny Fredrixon, Lidingö , Sweden

[73] Assignee: Ilsbo Industrier AB, Sweden

[21] Appl. No.: 735,729

[22] Filed: May 20, 1985

Related U.S. Application Data

[63] Continuation of Ser. No. 529,738, Sep. 6, 1983, abandoned.

[30] Foreign Application Priority Data

Jul. 12, 1983 [SE] Sweden ..... 8303938

[51] Int. Cl.[4] ..... F25D 25/00

[52] U.S. Cl. ..... 62/62; 62/371; 62/239; 62/388; 62/457

[58] Field of Search ..... 62/457, 371, 37 L, 529, 62/530, 384, 388, 62, 50, 239

[56] References Cited

U.S. PATENT DOCUMENTS

| | | | |
|---|---|---|---|
| 2,024,648 | 12/1935 | Kissling et al. | 62/388 |
| 2,632,311 | 3/1953 | Sullivan | 62/371 |
| 3,156,105 | 11/1964 | Bahner | 62/371 |
| 3,174,299 | 3/1965 | Ellis | 62/50 X |
| 3,557,569 | 1/1971 | Hill et al. | 62/50 X |
| 3,922,878 | 12/1975 | Jalali | 62/384 |
| 4,195,491 | 4/1980 | Roncaglione | 62/457 X |
| 4,288,996 | 9/1981 | Roncaglione | 62/457 X |

FOREIGN PATENT DOCUMENTS

| | | | |
|---|---|---|---|
| 159500 | 1/1933 | Switzerland | 62/371 |

*Primary Examiner*—Lloyd L. King

*Attorney, Agent, or Firm*—Shapiro and Shapiro

[57] ABSTRACT

Top structure for a transport compartment formed of a pallet with a so-called pallet collar or the like or of another upwardly openable container, which structure is adapted to upwardly close the compartment and to maintain cold in the goods contained in the transport compartment. The new feature is that a tank or container for cooling or freezing medium in liquid state is accommodated in the top structure, said tank being provided with a permanently open nozzle through which the medium after evaporation is adapted successively to flow out into the compartment under the top structure.

16 Claims, 4 Drawing Figures

TOP STRUCTURE

This is a continuation application of Ser. No. 529,738, filed Sept. 6, 1983, now abandoned.

The present invention relates to a top structure for a transport compartment formed of a pallet with a so-called pallet collar or the like or of another upwardly openable container, which structure is adapted to upwardly close the compartment and to maintain cold in goods contained in the transport compartment.

During transport of deep-frozen goods it is required that the goods be kept at a prescribed storing temperature. When transporting large goods volumes use is made of refrigerator vans provided with individual freezing systems. Transport of small amounts of goods, for instance deep-frozen foods, to one or a few retailers or consumers by means of refrigerator vans is expensive and not very expedient and involves unrational utilization of the refrigerator van. Also deep-frozen goods are therefore often, for reasons of freight costs, transported on conventional vehicles, which may lead to quality losses and risks for damages.

The object of this invention is to provide a simple and inexpensive structure primarily intended for use in the last part of the transport chain, i.e., when the large goods volume is divided into small lots to be distributed to consumers who may be spread over a relatively large area.

The new feature of the structure according to the invention is that at least one tank or container for cooling or freezing medium in liquid state is accommodated in the structure closing the top of the transport compartment, that at least one permanently open nozzle, debouching towards said compartment is connected to said tank or container, and that the tank or container has a filling opening provided with a quick coupling, and the medium is adapted, after being filled into the tank, to successively evaporate and in gaseous state to flow out into the transport compartment under the top structure.

The structure according to the invention makes it possible at a low cost to distribute also deep-frozen goods by means of conventional vehicles.

A preferred embodiment of the structure according to the invention will be described more fully below with reference to the accompanying drawings, in which.

Figure 1:
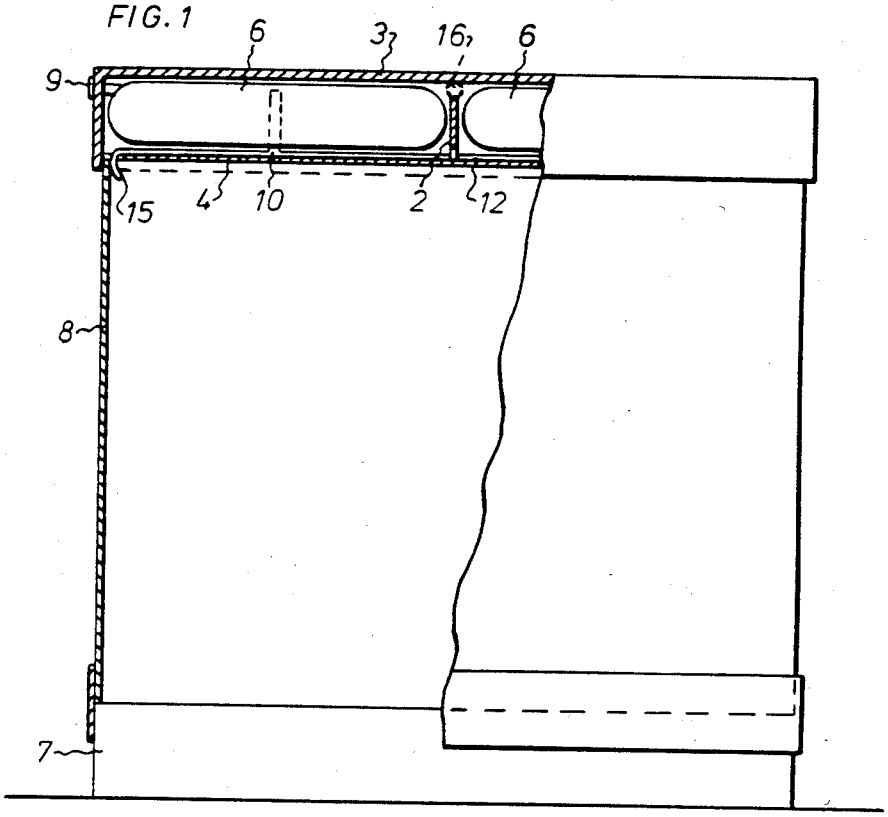
FIG. 1 is a side view showing partly in section a top structure according to the invention arranged on a pallet provided with a collar.

The top structure has a body including an outer frame 1 and a transverse support bar 2. A plate or sheet constituting the top side of the structure is designated by 3 while 4 designates a bottom plate. Arranged inside the two box-shaped cavities 5 in the structure are two tanks or containers 6 for the freezing medium which in the preferred embodiment is liquid nitrogen or carbon dioxide.

The pallet 7 and the collar 8 placed on it are substantially of conventional design. The pallet, however, consists preferably of light-metal or plastic material and is provided with insulation. The pallet collar 8 may consist of multi-layer corrugated fibre-board, aluminium plate with insulation layers of cellular material or the like.

Each tank 5, which is enveloped by an insulation, is provided with a filling pipe 9 provided with a quick coupling and an automatic valve permitting filling of freezing medium with a simple manipulation. Each tank has an outlet pipe 10. The outlet pipe 10 opens into a pipe system 12 arranged along the bottom plate 4 and including pipes 13 extending diagonally across either half of the structure towards pipes 14 extending along the long sides of the top structure. The pipes 13, 14 extend from either tank to the corners situated at the nearest respective tank as well as to the corners situated beyond the other tank. The pipe ends at all the corners have nozzles 15 which thus can be reached by freezing medium both from the nearest tank and from the remote tank. The nozzles are permanently open and directed downwards. As long as there is liquid freezing medium in one of the tanks it will be ejected in evaporated state through the nozzles.

The pipe system may serve as an anchoring system for rods or the like designed to carry hooks for suspended goods.

After the pallet has been loaded and the collar 8 has been put in position the tanks 6 in the top structure are filled with freezing medium from a preferably stationary container. After the top structure has been anchored, if required, the pallet is ready for transport. When one or both tanks have been filled the liquid medium starts to evaporate, under the influence of the ambient temperature and to flow out in gaseous state through the nozzles 15 and to fill up the space inside the pallet. To begin with air contained in the pallet space is forced out and so is later the excess of gasified freezing medium through evacuation openings, indicated by 16, at the center of the top structure.

On arrival with the consumer the top structure is lifted off and withdrawn for return transport and reuse together with pallets and the like.

The tanks and the insulation around them are adapted to permit evaporation of a predetermined amount of liquid medium per unit of time. In the example shown the tanks 6 are adjusted so that the amount of gas evaporated from one tank during the predetermined time unit is sufficient to keep the transport compartment at the temperature required for cold transport. Thus, in this connection only one tank is filled with liquid freezing medium. If the structure is to be used for transport of deep-frozen goods both tanks are filled and both of them are emptied within the same time unit as the medium gradually evaporates and flows out through the nozzles 15.

Figure 2:
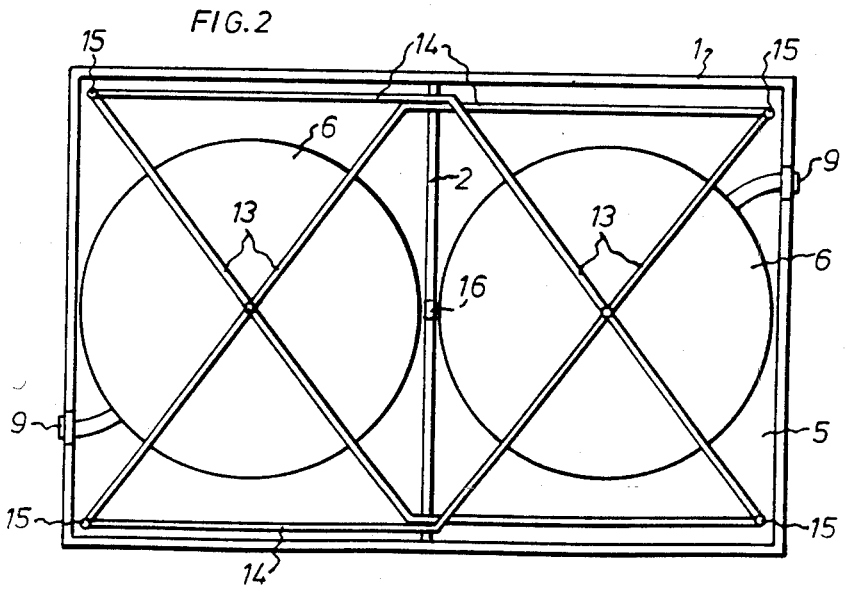
FIG. 2 is a bottom view of the same top structure.
Figure 3:
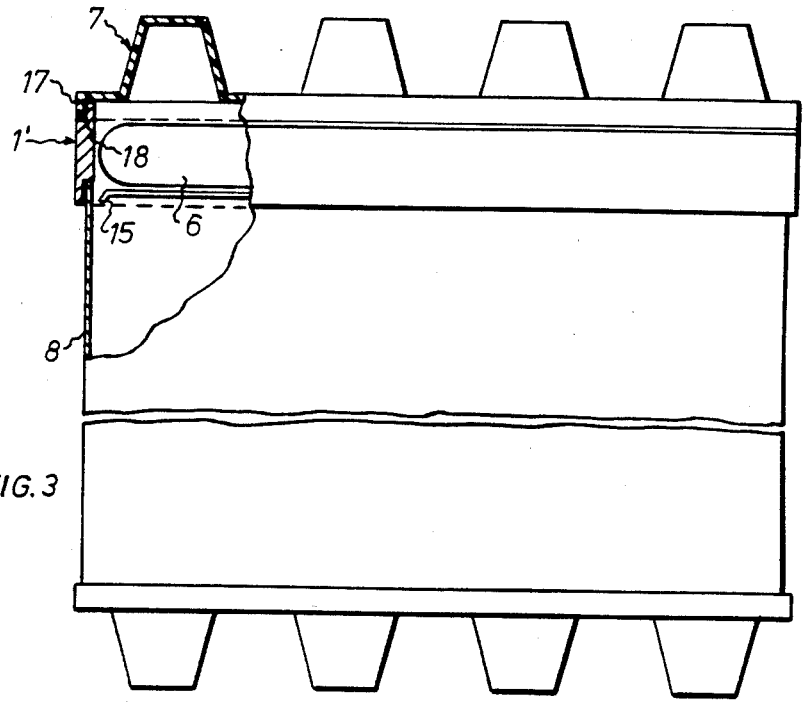
FIG. 3 is a side view showing partly in section a modified embodiment of the top structure.

The embodiment shown in FIG. 3 differs from that of FIGS. 1 and 2 in that the top structure is modified so as to permit fitting on the top of it a per se known pallet 7' in inverted position. Various designs of that type of pallets are known which are so constructed that in one position they function as a bottom and support for the load and in inverted position they can be fitted as a top closure for a pallet collar placed on the first pallet. The upper inverted pallet 7' is intended to receive and fix another loaded pallet placed on the top. The top structure according to FIG. 3 has a modified frame 1' adapted to be fitted inwards against the pallet collar 8 to receive the rim 17 of the inverted upper pallet 7'. The frame 1' has at its top a circumferentially extending recess 18 constituting an abutment for the pallet flange and the vertical side of which is alined with the plane of the inside of the pallet collar 8. In other respects this design substantially agrees with that of FIGS. 1 and 2.

Figure 4:
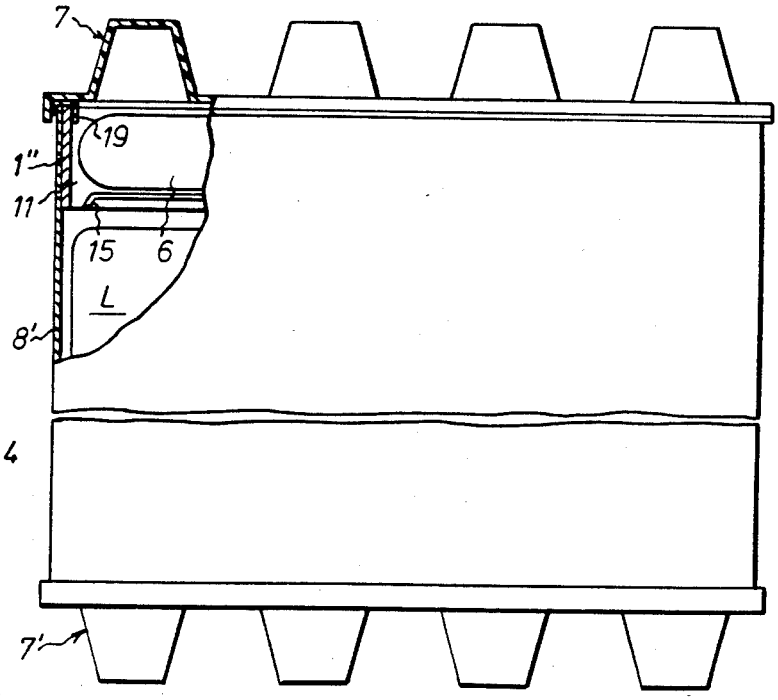
FIG. 4 is a corresponding view of another modified embodiment of the top structure.

Also the embodiment according to FIG. 4 is primarily intended for use for palletized loads where a bottom pallet 7' supports the load and a pallet collar surrounding the load and against the upper edge of which an inverted pallet 7' rests. When the structure of FIG. 4 is used the pallet collar 8' is taller than the load L. The frame 1'' of the top structure is in this case adapted to be pushed down into the pallet collar above the load. Arranged at the top of the frame 1'' are hooks 19, a projecting flange or the like intended to engage with the upper rim of the pallet collar 8. After such engagement an inverted pallet 7' can be placed on the edge of the pallet collar and the hooks or flange in the usual manner.

In the embodiments of FIGS. 3 and 4 in which the top structure is mechanically protected by the inverted pallet placed on its top design of this structure may be simplified. In the embodiment according to FIG. 3 the frame 1' of the top structure must be able to transmit the weight from an overlying load to the pallet collar. In the embodiment of FIG. 4 the top structure is entirely unloaded and therefore the frame can be of a simple design.

The structure according to the invention is extremely simple, easily handled and inexpensive. The uncomplicated construction makes it possible to use the structure repeatedly without any maintenance worth mentioning. Decisive for the gas emission is the insulation capacity of the insulation layers of the tanks and the ambient temperature. Valves, thermostats and other checking means are quite unnecessary. Since a pressureless freezing medium, preferably liquid nitrogen, is used it is possible to manufacture the tanks at a low cost in contrast to pressure vessels.

The invention must not be considered restricted to that described above and shown in the drawings but may be modified in various ways within the scope of the appended claims.

What I claim and desire to secure by Letters Patent is:

1. A method of cooling goods to be transported, comprising providing an open top transport compartment, placing goods to be cooled in said transport compartment, closing the open top of the transport compartment with a top structure having cavity means with unpressuirzed tank means therein connected to permanently open nozzle means by open pipe means and having a quick coupling with an automatic valve, filling said tank means via said quick coupling and automatic valve with an unpressurized liquid cooling medium, and causing said cooling medium to evaporate and to flow in a gaseous state through said pipe means and downwardly through said nozzle means into said compartment.

2. A method in accordance with claim 1, wherein the flow of said cooling medium in said gaseous state is controlled merely by the rate of evaporation of said liquid cooling medium at the temperature in said tank means.

3. A method in accordance with claim 2, further comprising providing insulation about said tank means to control the temperature in said tank means and hence the rate of evaporation of said liquid cooling medium.

4. A top structure for closing the top of an upwardly open transport compartment and for cooling goods contained in the transport compartment, said top structure having means for supporting the same at the top of said compartment in a position for closing the top of said compartment and having cavity means with unpressurized tank means therein for receiving a liquid cooling medium that evaporates to a gaseous state, means including a quick coupling with an automatic valve for filling said tank means with liquid cooling medium, and permanently open nozzle means connected to said tank means by open pipe means for causing the cooling medium in a gaseous state to flow downwardly into said compartment.

5. A top structure as claimed in claim 4, wherein said tank means comprises a plurality of tanks and wherein said nozzle means comprises a plurality of permanently open nozzles connected to all of said tanks by a pipe system.

6. A top structure as claimed in claim 4, wherein said top structure is rectangular and said nozzle means includes permanently open nozzles positioned at the corners of the top structure.

7. A top structure as claimed in claim 4, wherein the tank means is surrounded by insulation means for controlling the rate of evaporation of the liquid cooling medium.

8. Apparatus comprising an upwardly open transport compartment having a top structure supported thereon and closing the top of said compartment, said top stucture comprising cavity means having unpressurized tank means therein for receiving a liquid cooling medium that evaporates to a gaseous state, filling means including a quick coupling with an automatic valve for supplying liquid cooling medium to said tank means, and permanently open nozzle means connected to said tank means by open pipe means for causing the cooling medium in a gaseous state to flow downwardly into said compartment.

9. Apparatus as claimed in claim 8, wherein said compartment comprises a pallet and a pallet collar thereon.

10. Apparatus as claimed in claim 9, wherein said top structure comprises means for supporting the same upon the top edge of said pallet collar.

11. Apparatus as claimed in claim 10, further comprising an inverted pallet supported on the top structure.

12. Apparatus as claimed in claim 9, wherein said top structure comprises means for supporting the same within said pallet collar.

13. Apparatus as claimed in claim 11, further comprising an inverted pallet supported on the top edge of the pallet collar.

14. Apparatus as claimed in claim 8, wherein said tank means comprises a plurality of tanks and wherein said nozzle means comprises a plurality of permanently open nozzles connected to all of said tanks by a pipe system.

15. Apparatus as claimed in claim 8, wherein said top structure is rectangular and said nozzle means includes permanently open nozzles positioned at the corners of the top structure.

16. Apparatus as claimed in claim 8, wherein the tank means is surrounded by insulation means for controlling the rate of evaporation of the liquid cooling medium.

* * * * *